US008532474B2

(12) United States Patent
Campbell

(10) Patent No.: US 8,532,474 B2
(45) Date of Patent: Sep. 10, 2013

(54) MOLECULAR HEATER AND METHOD OF HEATING FLUIDS

(76) Inventor: Mark E. Campbell, Ada, MI (US)

( * ) Notice: Subject to any disclaimer, the term of this patent is extended or adjusted under 35 U.S.C. 154(b) by 281 days.

(21) Appl. No.: 12/921,301

(22) PCT Filed: Mar. 5, 2009

(86) PCT No.: PCT/US2009/036191

§ 371 (c)(1),
(2), (4) Date: Sep. 7, 2010

(87) PCT Pub. No.: WO2009/111640

PCT Pub. Date: Sep. 11, 2009

(65) Prior Publication Data

US 2011/0008026 A1 Jan. 13, 2011

Related U.S. Application Data

(60) Provisional application No. 61/033,974, filed on Mar. 5, 2008.

(51) Int. Cl.
*H05B 3/60* (2006.01)
*E03B 9/00* (2006.01)

(52) U.S. Cl.
USPC ..... 392/311; 392/312; 392/313; 392/314; 392/315; 392/316; 137/3

(58) Field of Classification Search
USPC ..... 392/311–316; 137/3
See application file for complete search history.

(56) References Cited

U.S. PATENT DOCUMENTS

| | | | |
|---|---|---|---|
| 2,188,625 | A | 1/1940 | Dufour et al. |
| 2,469,709 | A | 5/1949 | Ashworth et al. |
| 3,060,297 | A | 10/1962 | Sargeant |
| 3,273,629 | A | 9/1966 | Sargeant |
| 3,315,681 | A | 4/1967 | Poppendiek |
| 3,945,170 | A | 3/1976 | Brown |
| 3,980,855 | A | 9/1976 | Boudouris et al. |

(Continued)

FOREIGN PATENT DOCUMENTS

| | | | |
|---|---|---|---|
| JP | 9-92448 | A | 4/1997 |
| JP | 2000-121153 | A | 4/2000 |
| JP | 2000-200675 | A | 7/2000 |
| JP | 2003-100427 | A | 4/2003 |

OTHER PUBLICATIONS

Evironmental Protection Agency (EPA), Emergency Disinfection of Drinking Water, Aug. 2006, EPA—816-F-06-02.*

Spa Tips and Tricks, Water Tips, 2005, Spa and Deck Creations.*

(Continued)

*Primary Examiner* — Sang Paik
*Assistant Examiner* — Renee L Miller
(74) *Attorney, Agent, or Firm* — Gardner, Linn, Burkhart & Flory, LLP

(57) ABSTRACT

An electrical liquid heating system and method of heating a liquid includes providing at least two spaced apart electrical conductors and applying an electrical energy source to the conductors. A liquid is directed into contact with the conductors thereby delivering electrical energy to the liquid. Electrical energy is delivered to the liquid at a power level that is sufficient to generate an electrical current to produce resistive heating of the liquid. The electrical energy may be delivered to the liquid at a power level that is sufficient to break at least some molecular bonds of molecules defining the liquid. A regulator may be provided for regulating delivery of electrical energy to the liquid.

32 Claims, 8 Drawing Sheets

(56) References Cited

U.S. PATENT DOCUMENTS

| | | | | |
|---|---|---|---|---|
| 3,983,359 | A | 9/1976 | Walker et al. | |
| 4,117,048 | A * | 9/1978 | Stockner et al. | 261/93 |
| 4,519,919 | A * | 5/1985 | Whyte et al. | 210/695 |
| 4,814,567 | A | 3/1989 | De Angelis et al. | |
| 5,222,185 | A | 6/1993 | McCord, Jr. | |
| 5,306,887 | A | 4/1994 | Smith | |
| 5,506,391 | A | 4/1996 | Burayez et al. | |
| 5,565,067 | A | 10/1996 | Chaffin, III | |
| 5,583,960 | A | 12/1996 | Reznik | |
| 5,768,472 | A | 6/1998 | Reznik | |
| 6,303,166 | B1 | 10/2001 | Kolbe et al. | |
| 6,522,834 | B1 * | 2/2003 | Herrick et al. | 392/311 |
| 6,859,617 | B2 | 2/2005 | Goodsel et al. | |
| 6,967,315 | B2 | 11/2005 | Centanni et al. | |
| 7,050,706 | B2 * | 5/2006 | Israelsohn et al. | 392/316 |
| 7,057,140 | B2 * | 6/2006 | Pittman | 219/481 |
| 2002/0096515 | A1 * | 7/2002 | Petrenko | 219/770 |
| 2006/0291527 | A1 * | 12/2006 | Callahan et al. | 373/108 |
| 2007/0128477 | A1 * | 6/2007 | Calhoon | 429/13 |
| 2009/0074389 | A1 | 3/2009 | Noe et al. | |

OTHER PUBLICATIONS

International Search Report and Written Opinion of the International Searching Authority from corresponding Patent Cooperation Treaty (PCT) Application No. PCT/US09/36191, mailed Sep. 29, 2009.

* cited by examiner

MOLECULAR HEATER AND METHOD OF HEATING FLUIDS

CROSS REFERENCE TO RELATED APPLICATION

This application is a filing under 35 U.S.C. §371 of International Application No. PCT/US2009/036191 filed Mar. 5, 2009, which claims priority from U.S. provisional patent application Ser. No. 61/033,974, filed on Mar. 5, 2008, the disclosures of which are hereby incorporated herein by reference in their entirety.

BACKGROUND OF THE INVENTION

The present invention is directed to a heating/evaporating system and method of heating/evaporating a liquid. The invention is also directed to a method of reducing microbes in a liquid.

Traditional electrical resistance heating systems heat and/or evaporate a liquid by generating heat within an electrical resistance element, which heat is transferred to a liquid to either heat the liquid or evaporate the liquid. Because heat is generated by the device, per se, the remainder of the components of the system, such as the housing, or the like, is traditionally made from a metal, Bakelite, or the like. When used to heat water in a hot tub or swimming pool, additional devices are required in order to destroy microbes in the water, traditionally by chemical treatment of the microbes. Because of the heat generated by the resistance heater, difficulties may arise should the supply of liquid be interrupted. This could result in an overheating of the heater element, thereby requiring thermal overload protection. Also, the heat being generated by the resistance heater creates potentially explosive liquids, such as gasoline, or the like.

SUMMARY OF THE INVENTION

The present invention is directed to an electrical liquid heating system and method of heating a liquid that is exceptionally efficient in conversion of electrical energy to heat energy in the liquid and which is capable of producing other beneficial effects.

An electrical liquid heating system and method of heating a liquid, according to an aspect of the invention, includes providing at least two spaced apart electrical conductors and applying an electrical energy source to the conductors. A liquid is directed into contact with the conductors thereby delivering electrical energy to the liquid. Electrical energy is delivered to the liquid at a power level that is sufficient to generate an electrical current to produce resistive heating of the liquid and to break at least some molecular bonds of molecules defining the liquid.

The electrical energy source may deliver energy at 2 kilowatts or greater. The electrical energy source may deliver electrical energy at between 50 and 60 hertz and at least 110 volts.

An electrical liquid heating system and method of heating a liquid, according to another aspect of the invention, includes providing at least two spaced apart electrical conductors and applying an electrical energy source to the conductors. A liquid is directed into contact with the conductors thereby delivering electrical energy to the liquid. Electrical energy is delivered to the liquid at a power level that is sufficient to generate an electrical current to produce resistive heating of the liquid. A regulator is provided for regulating the delivery of electrical energy to the liquid. The regulator may function by disrupting the delivery of energy to a particular volume of the flowing liquid. This may be accomplished by creating non-conductive breaks in at least one of said conductors. The non-conductive breaks may be in the form of openings in the conductor that are spaced along the direction of liquid flow to provide a switching of the current through the liquid. Alternatively, the non-conductive breaks may be in the form of insulators spaced along the conductor along the direction of liquid flow. Alternatively, the non-conductive breaks may be made by dividing of the conductor into a series of electrically interconnected conductor segments spaced apart in the direction of liquid flow. At least one electrical switch may be provided to selectively interconnect particular conductor segments in order to control total conductive surface area. The electrical switch may be mounted in thermal contact with the conductor to discharge heat to the liquid.

The regulator may be in the form of a source of gas bubbles dispersed in the liquid. An increase in gas bubbles reduces the amount of energy delivered to the liquid. The source of gas bubbles may create air bubbles, such as with a venturi tube in the liquid flow path and drawing air from external the liquid. The source of gas bubbles may be another set of conductors connected with the energy source that separate gas from the liquid by breaking at least some molecular bonds of molecules defining the liquid.

A mono-polar magnet, which may be a permanent magnet or an electro-magnet, may be provided in the liquid stream, such as after the conductors, in order to neutralize polarization of particles in the water created by said electrical energy source operating at relatively low frequency. This prevents the particles from adhering to each other. If it is desired to allow the particles to adhere to each other, in order to make the particles easier to filter from the liquid, the magnet can be eliminated, thereby allowing particles in different portions of the liquid to be oppositely polarized and thereby magnetically attracted to each other. Also, a filter (not shown) may be oppositely charged to further attract the charged particles. Alternatively, multiple oppositely charged paths may be provided downstream of the system to direct charged particles in different directions.

A housing may be provided to enclose the conductors and liquid flow path. The housing may define a liquid inlet and a liquid outlet and include a ground plane positioned around the liquid inlet, the liquid outlet, or both. This significantly reduces any electric charge in the liquid exiting the system. The housing may be made in whole or in part from an electrically insulating material, such as a polymeric material or of an outer conductive material with a non-conductive spacer between the outer housing and the electrode.

An electrical liquid heating system and method of heating a liquid, according to the various embodiments of the invention disclosed herein, may have many beneficial applications. For example, it may be used to heat and/or treat the water of a hot tub or a swimming pool. In such an application, the breaking of at least some molecular bonds produces free oxygen that reduces microbes in the water. Also, by adding a salt to the water, the breaking of at least some molecular bonds produces chlorine that further reduces microbes in the water.

The various embodiments of the invention may be used to heat water in-line in a water supply system to a building. It may also be used to heat water used in a radiant heating system.

The various embodiments of the invention may be used to evaporate a liquid to a gas fluid. Because the electrical energy source heats the liquid and not the conductors, it may be used to process combustible liquids, such as hydrocarbons, without igniting the liquid. Thus, it may be used to heat fuel in an engine in order to convert the fuel to a gas to supply the fuel to the cylinders. Other embodiments will be apparent to the skilled practitioner.

These and other objects, advantages and features of this invention will become apparent upon review of the following specification in conjunction with the drawings.

DESCRIPTION OF THE PREFERRED EMBODIMENT

Figure 1:
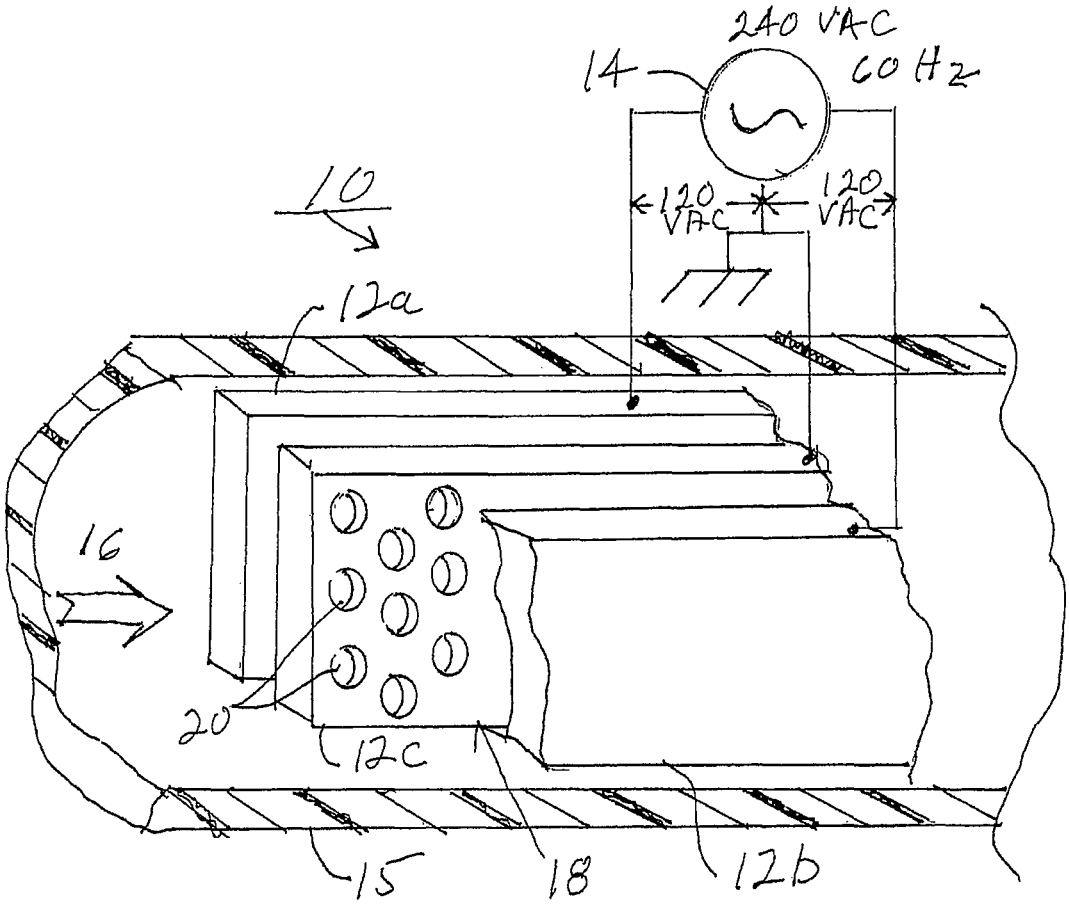
FIG. 1 is an electrical schematic diagram of an electrical liquid heating system, according to an embodiment of the invention.

Referring now specifically to the drawings, and the illustrative embodiments depicted therein, an electrical liquid heating system 10 includes at least two spaced apart electrical conductors 12*a* and 12*b* and an electrical energy source 14 applied to the conductors, such as by electrical wiring (FIG. 1). A liquid flow path 16 is provided to direct liquid into contact with conductors 12*a*, 12*b* thereby delivering electrical energy to the liquid. As will be described in more detail below, electrical energy source 14 delivers electrical energy to the liquid at a power level that is sufficient to generate an electrical current to produce resistive heating of the liquid. The energy source may further operate at a power level sufficient to break at least some molecular bonds of molecules defining the liquid.

In the illustrated embodiment, electrical energy source 14 delivers electrical energy at conventional house mains, such as in the range of between 110 volts AC and 240 volts AC and in a frequency range of between 50 and 60 hertz. The power source may be applied across conductors 12*a*, 12*b*. Alternatively, a third center conductor 12*c* may be provided between conductors 12*a* and 12*b*. In such a configuration, the center conductor may be connected with ground, or the neutral terminal, and a 240 volts AC source applied across outer conductors 12*a* and 12*b*. This creates a nominal potential of 120 volts AC between conductor 12*a* and 12*c* and a nominal potential of 120 volts AC between conductors 12*b* and 12*c* that is out of phase with the voltage across conducts 12*a* and 12*c*. Electrical liquid heating system 10 includes a housing 15 which encloses conductors 12*a*, 12*b*, and 12*c* and defines flow path 16. Because the liquid is heated from current passed through the liquid rather than by heating of the conductors, housing 15 can be made in whole or in part from a low temperature polymeric material, such as PVC, or the like.

Electrical liquid heating system 10 delivers sufficient levels of electrical current density to the liquid flowing along liquid flow path 16 to heat the water. Also, it is capable of delivering sufficient levels of electrical current density to the liquid to disrupt some of the molecular bond in the liquid. For example, if the liquid is water, one or both of the hydrogen atoms may be liberated from the oxygen atom. This is believed to have at least two beneficial effects. It is believed that this breaking of molecular bonds contributes additional energy to further heat the liquid beyond the heating that occurs from the resistive heating caused by the current flow. Also, this breaking of molecular bonds results in the liberation of gas(es) from the liquid. In the case of water, the liberation of oxygen creates known beneficial effects. For example, the oxygen provides an anti-microbial effect to reduce microbes in, for example, swimming pools and spas. Also, it may make water into a health drink and may even make certain non-potable water into potable water.

Electrical heating system 10 is capable of delivering energy at a sufficiently high power level to supply the water needs of a building or to heat as well as treat the water to kill microbes for a hot tub or a swimming pool. In the illustrative embodiment, the system is capable of applying up to 2 kilowatts and even up to 5 kilowatts or greater of power to the liquid.

A regulator 18 may be provided for regulating the delivery of electrical energy from source 14 to the liquid. This, for example, regulates the flow of current through the liquid to prevent an excessive amount of current draw on the source. Because electrical energy source 14 has a relatively low frequency, it may otherwise be possible for the molecules in the liquid to align with each other in response to the field created across conductors 12*a*, 12*b* in a manner that produces an excessive current during the half cycle of the electrical energy source when one of the conductors 12*a* is at one polarity and the other conductor 12*b* is at an opposite polarity. Regulator 12 functions by disrupting the delivery of energy to a particular volume of the liquid flowing between the conductors. This may be accomplished by creating non-conductive breaks in at least one of the conductors. The non-conductive breaks may be, for example, in the form of openings, such as through-openings 20, in the conductor that are spaced along the direction of liquid flow. In the illustrative embodiments, openings 20 are formed in the center conductor 12*c*. However, they could be in outer conductors 12*a* and 12*b* or in all of the conductors. The non-conductive breaks operate as follows. As a given volume of the liquid flows along flow path 16, that volume will alternate between conductive portions of the conductors and portions of the conductors having the non-conductive breaks. When that volume of liquid is exposed to the conductors, a current will form in that volume and the water will be heated and/or treated. When that volume of liquid is exposed to the non-conductive breaks, the current will be cut or reduced thereby preventing excessive current from arising in the liquid. The energy delivered to the liquid crossing the plates also aids in killing microbes. It should be understood that certain applications may not call for the liberation of gas from the liquid. In such applications, the level of electrical current density can be lowered to provide only resistive heating of the liquid. In the illustrative embodiment, the conduits are made of a non-corroding material, such as stainless steel. However, other metals or semi-conductor materials may be used for particular applications.

Figure 2:
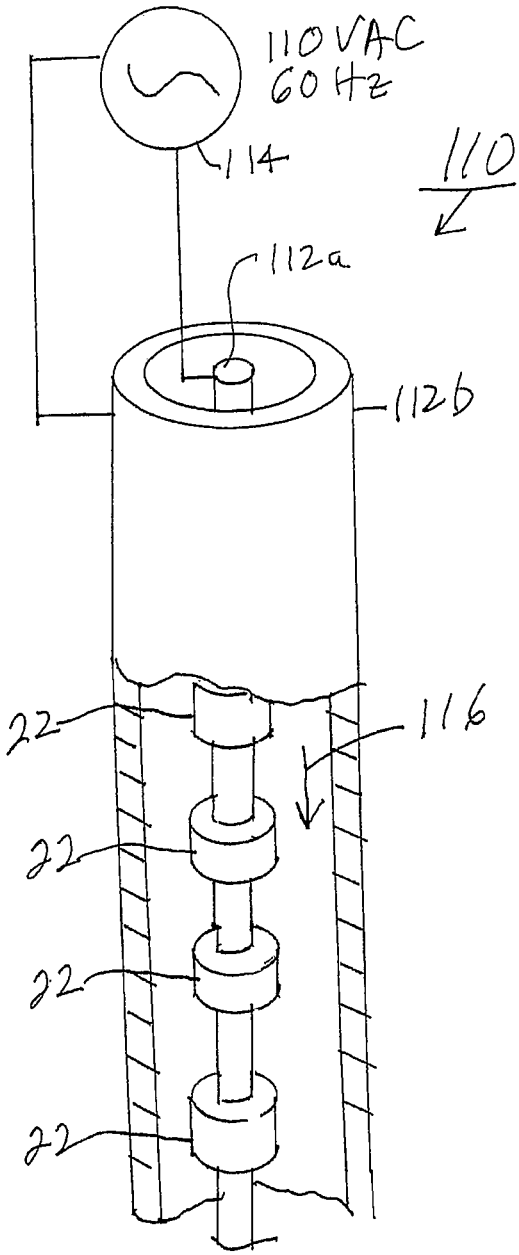
FIG. 2 is the same view as FIG. 1 of an alternative embodiment thereof.

In an alternative embodiment, an electrical heating system 110 has a conductor 112*a* in the form of a central rod form that is surrounded by a concentric conductor 112*b* in the form of a cylinder (FIG. 2). An alternative form of non-conductive breaks may be in the form of insulators 22 spaced along conductor 112 along the direction of liquid flow along a flow path 116. The electric energy source 114, which may be 110 volts AC at 50 to 60 Hz, is applied across conductors 112*a*, 112*b*. As the liquid flows along flow path 116, a given volume of liquid is alternatingly exposed to areas where it is able to contact both conductors 112*a* and 112*b*, thus allowing a current to be developed in the liquid. When that same volume passes by an insulator 22, the current is interrupted or reduced thereby preventing excessive current from arising in the liquid. As can be seen by reference to FIG. 3, a plurality of electrical heating systems 110 may be combined in a parallel fashion in a housing 115, such that liquid flow is divided among heating systems 110. A bypass liquid flow tube 117 may be provided to allow liquid to selectively bypass the heating systems and may be controlled in a manner that regulates the rate of liquid heating.

Figure 5:
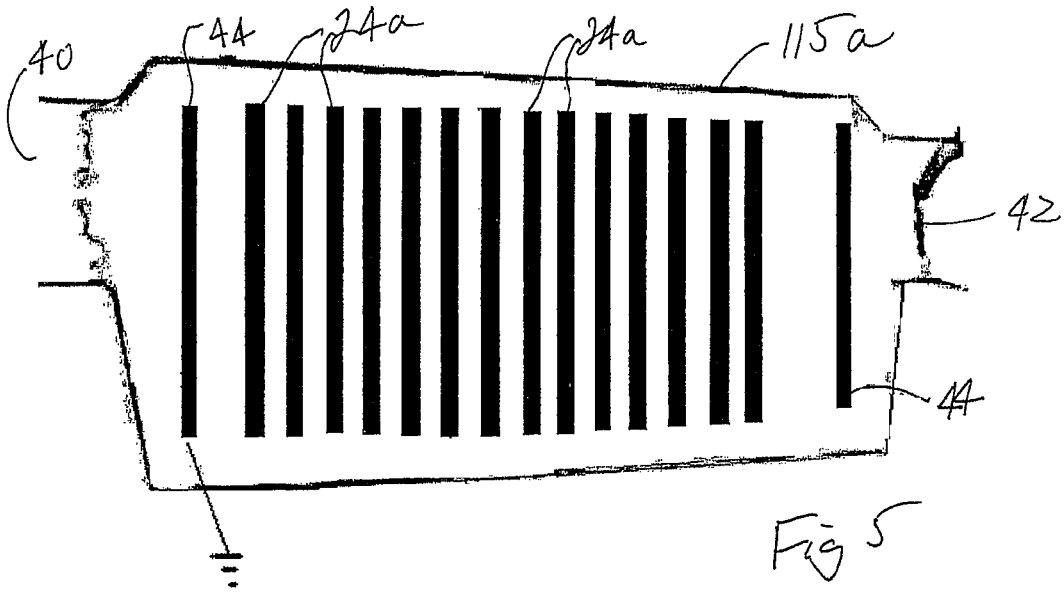
FIG. 5 is a view taken from the direct V-V in FIG. 4.
Figure 6:
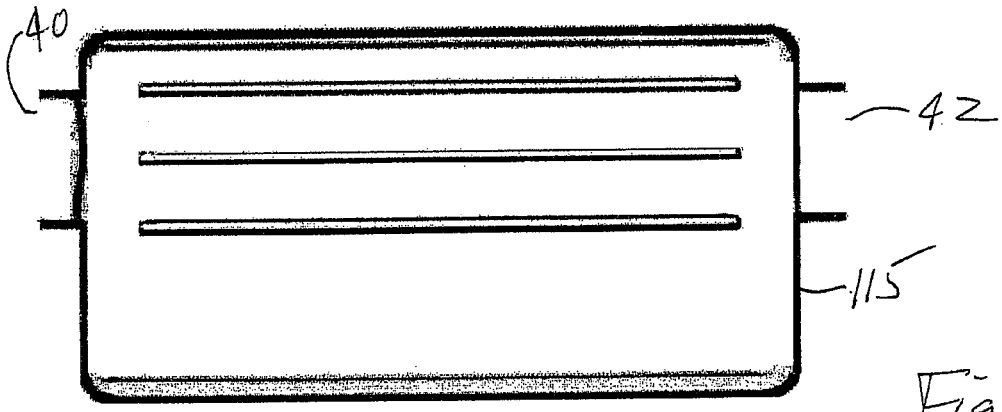
FIG. 6 is the same view as FIG. 5 of the outside of the housing.

In another alternative embodiment, an electrical heating system 210 has a conductor 221*a* that is separated from a conductor 221*b* by a liquid flow path 216. Each of the conductors is divided into a series of electrically interconnected conductor segments 24*a* for conductor 221*a* and 24*b* for conductor 221*b* that are spaced apart in the direction of liquid flow. Conductor segments 24*a* may be permanently or temporarily electrically interconnected to each other and to an electrical energy source 214. Conductor segments 24*b* may also be permanently or temporarily electrically interconnected to each other and to electrical energy source 214. As the liquid flows along liquid flow path 216, a given volume of liquid alternatingly is positioned between a pair of conductor segments 24*a* and 24*b* and the space where the conductor segments are absent. When between the conductor segments, electrical energy source will cause a current to develop in the given volume of liquid. When that volume is in the space where the conductor segments are absent, the current will break or be diminished. Conveniently, conductor segments 24*a* may be molded into a wall 215*a* defining half of a housing 215 (FIGS. 5 and 6). Segments 24*b* may be molded into the other housing half. Of course, conductor segments 24*a* and 24*b* could be mounted on a common half of a housing in alternatingly fashion in the direction of liquid flow. In such embodiment, the other housing half could be plain.

Figure 3:
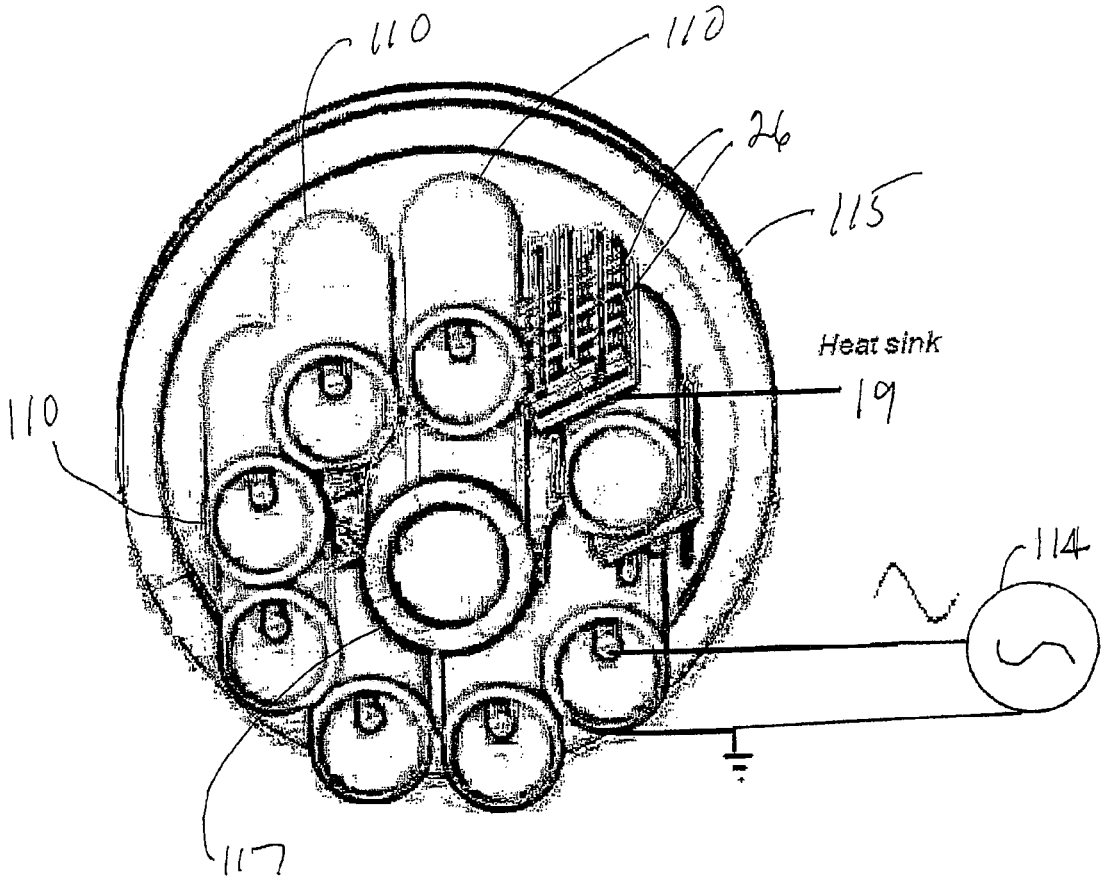
FIG. 3 is a perspective view of yet another alternative embodiment of an electrical liquid heating system.
Figure 4:
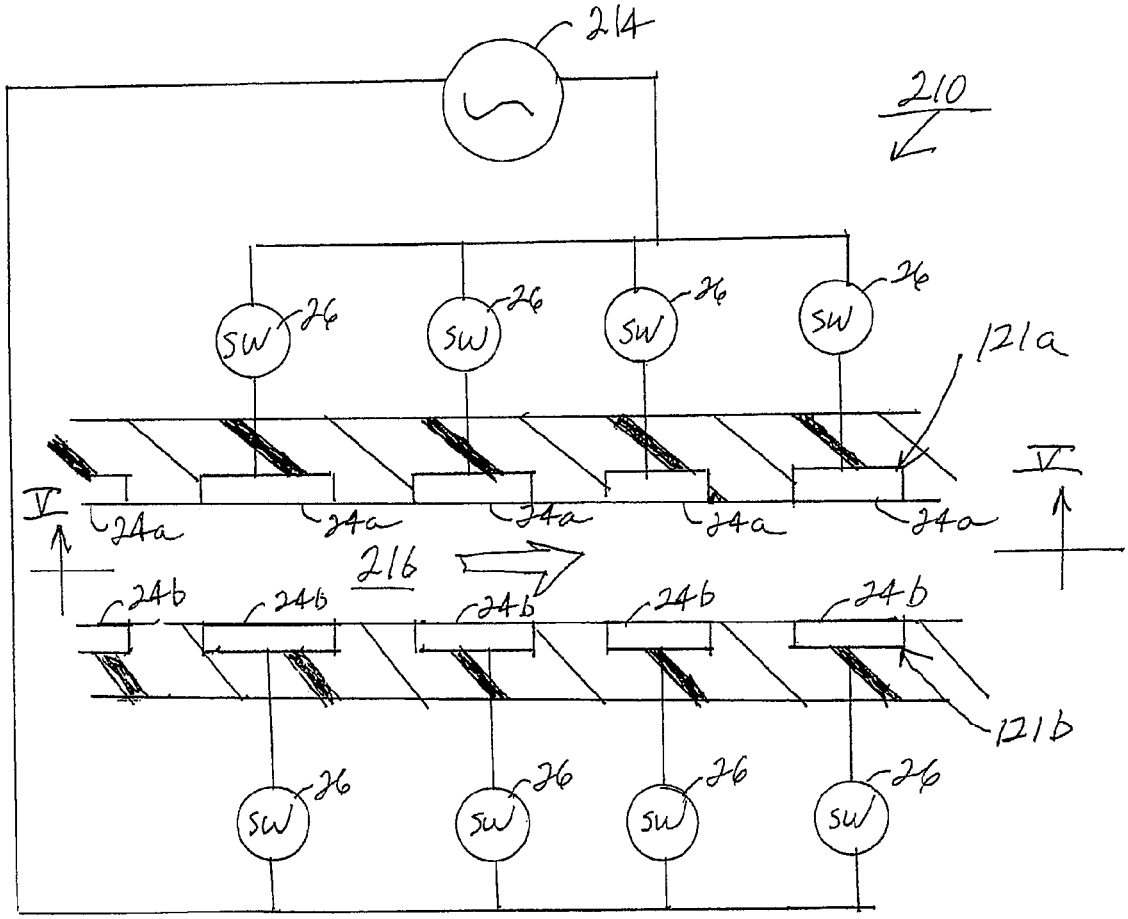
FIG. 4 is a sectional view of yet another alternative embodiment of an electrical liquid heating system.
Figure 7:
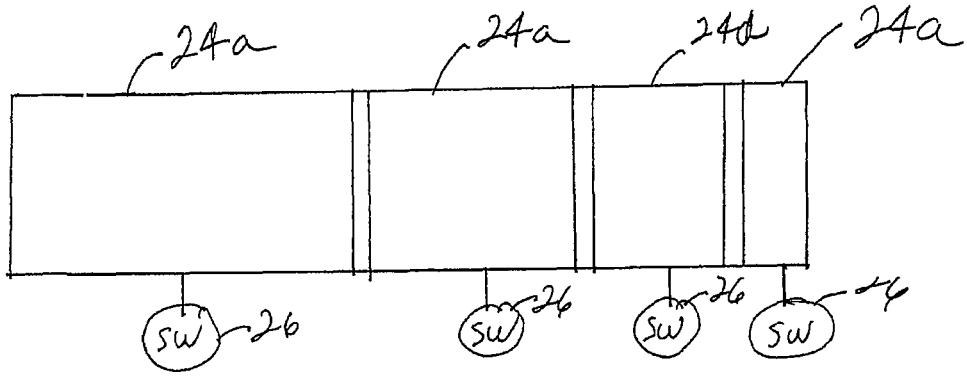
FIG. 7 is the same view as FIG. 5 of yet another alternative embodiment.

Electrical heating system 210 may include one or more electrical switches 26 to selectively interconnect particular conductor segments 24*a*, 24*b* to electrical energy source 214 in order to control total conductive surface area of one or both of conductors 212*a* and 212*b*. By causing the electrical switch (es) to be open, a number of conductor segments 24*a*, 24*b* are not capable of causing an electrical current to form in the liquid. When the electrical switch(es) are closed, a larger number of conductor segments are capable of inducing a current in the liquid. Thus, by opening and closing electrical switch(es) 26, the amount of electrical energy delivered to the liquid can be controlled. As would be apparent to the skilled artisan, the sizes of conductor segments 24*a*, 24*b* can be varied, each separately connectable with a switch 26 to electrical energy source 214 to allow a variety of energy levels to be applied to the liquid by closing a various combination of the switches as illustrated in FIG. 7. Electrical switch(es) 26 may be solid state switches, such as triacs, and may be mounted to a heat sink 19 in thermal contact with one or both of the conductors to discharge heat to the liquid (FIG. 3). Thus, any heat generated by the electrical switches is delivered to the liquid thereby contributing to the heating of the liquid rather than being wasted. Also, by controlling the actuation of electrical switches 26 to open and/or close only at zero crossing of energy source 214, using known control techniques, harmful effects such as electrical and audio noise as well as disruptive effects to the power source may be substantially avoided. Housing 115 may define a liquid inlet 40 and a liquid outlet 42 and include a ground plane 44 positioned around the liquid inlet, the liquid outlet, or both. This significantly reduces any electric charge in the liquid exiting the system. Alternatively, if both sets of conductor segments are mounted to one housing wall, the other housing wall may be covered with a ground plane. Housing 115 may be made in whole or in part from an electrically insulating material, such as a polymeric material.

Figure 8:
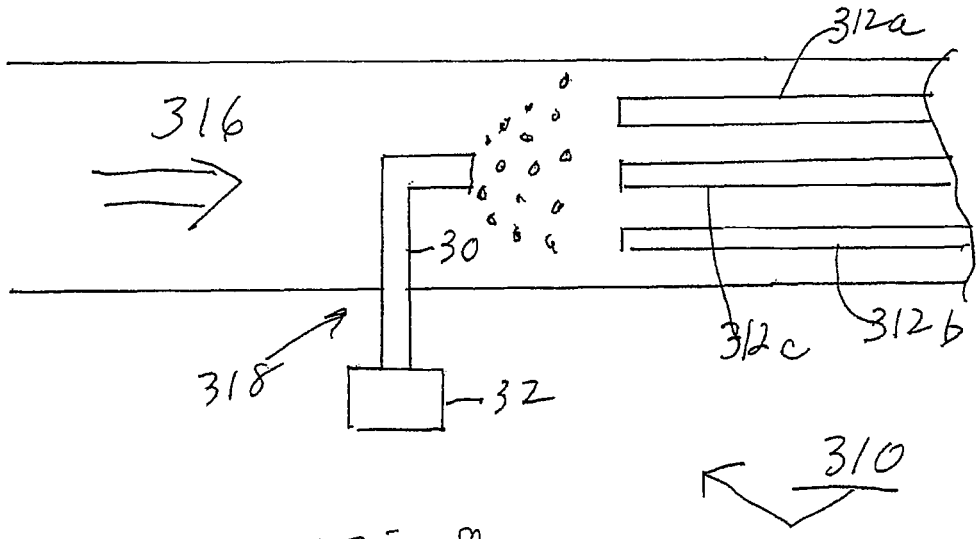
FIG. 8 is the same view as FIG. 1 of yet another alternative embodiment.
Figure 9:
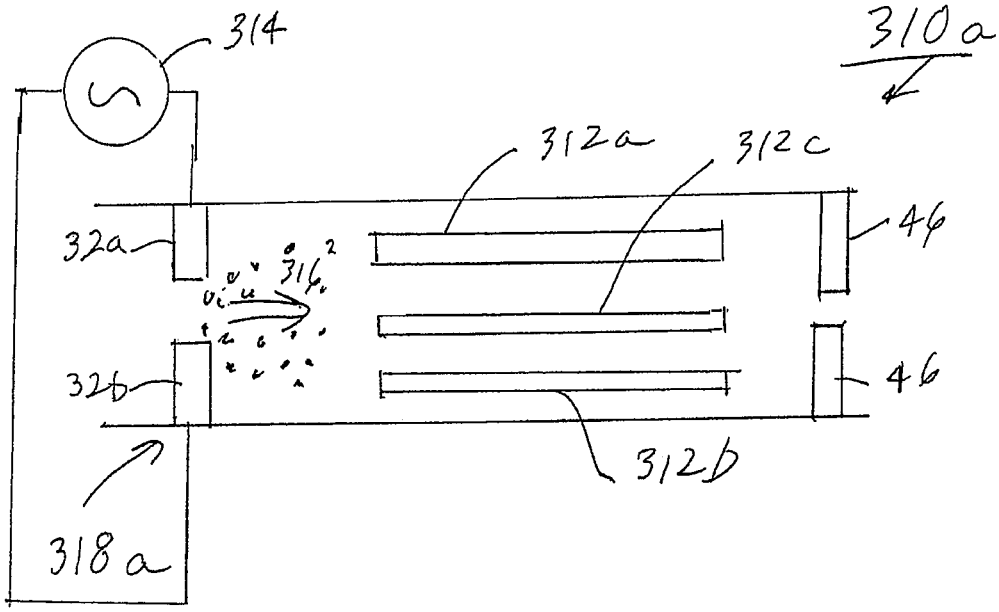
FIG. 9 is the same view as FIG. 1 of yet another alternative embodiment.
Figure 10:
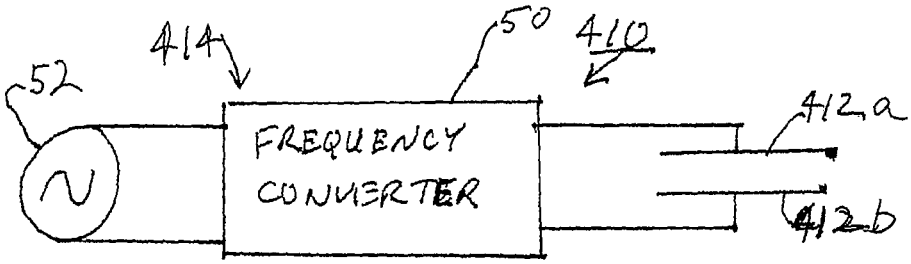
FIG. 10 is the same view as FIG. 1 of yet another alternative embodiment.

In yet another alternative embodiment of the invention, an electrical heating system 310 includes a regulator 318 that is provided for regulating the delivery of electrical energy from a source of electrical energy 314 to the liquid (FIG. 8). The liquid is delivered along flow path 316 past a set of conductors 312*a*, 312*b*. Regulator 318 may be in the form of a source of gas bubbles dispersed in the liquid. An increase in gas bubbles reduces the amount of energy delivered to the liquid because it disrupts the alignment of molecules that allows an electrical current to flow through a given volume of the liquid. Conversely, a decrease in gas bubbles increases the amount of energy delivered to the liquid because it allows a greater alignment of the molecules of the liquid thus allowing an increase in electrical current to flow through a given volume of the liquid. Regulator 318 may include a source of gas bubbles in the form of air bubbles by providing a venturi tube 30 positioned upstream in the liquid flow path 316 and drawing air from external the liquid. As would be apparent to the skilled practitioner, a lesser amount of air bubbles could be regulated by having a controllable orifice 32 in venturi tube 30. Indeed, controllable orifice 32 may be electrically operated in a control loop with a sensor that senses the current supplied by electrical energy source 314. In this manner, the amount of air bubbles supplied to the liquid could be regulated to maintain a constant current supplied from the electrical energy source to the liquid.

Alternatively, a system 310*a* may include a regulator 318 providing a source of gas bubbles produced from another set of conductors 32*a*, 32*b* connected with energy source 314 upstream of conductors 312*a*, 312*b*, 312*c*. Using the principles described herein, conductors 32*a*, 32*b* could be designed for optimal breaking of molecular bonds in the liquid thereby producing gas bubbles of the gas liberated from the liquid. As the amount of gas liberation is increased, the less amount of current will flow through the liquid from conductors 312*a*, 312*b*. One or more mono-polar magnets 46 may be provided in the liquid stream in order to neutralize polarization of particles in the water created by said electrical energy source. This prevents the particles from adhering to each other. If it is desired to allow the particles to adhere to each other, in order to make the particles easier to filter from the liquid, the magnet can be eliminated thereby allowing particles in different portions of the liquid to be oppositely polarized and thereby magnetically attracted to each other.

In yet a further embodiment, an electrical liquid heating system 410 may include an electrical energy source 414 that produces alternating current or pulsed DC at a high frequency. The high frequency alternating current causes vibration of the molecules within the liquid. Because the motion is at a high frequency, enhanced collision between the molecules increases the amount of heating of the liquid at energy levels below those that break the molecular bonds. This assists in microbe destruction. In the illustrated embodiment, power source 414 produces alternating current or pulsed DC at a frequency of at least one kilohertz. While 60 hertz will heat the liquid, the higher frequencies make the system more efficient by causing the molecular friction to aid in the heating process. The power source may produce an alternating current at a frequency in the range of between approximately 50 kilohertz and approximately 70 kilohertz. However, lower or greater frequencies may be used. Power source 414 may include a frequency converter 50 that is supplied from house power, shown at 52, such as 120 volts AC or 240 volts AC at 60 hertz and increases the frequency of the power that is supplied to conductors 412*a*, 412*b*. The design of frequency converter 16 would be apparent to the skilled artisan and may include a rectifier network to obtain ungrounded direct current and an H-bridge to convert the direct current to alternating current at a frequency established by the components of the bridge or may be applied as pulsed DC. Other techniques for frequency conversion would be apparent to the skilled artisan. The pulsed DC may have application in separating particles from the liquid. For example, a divergent downstream flow path may be provided with one leg charged oppositely to the particle charge thus diverting particles away from the liquid, such as for liquid purification. Alternatively, a filter may be provided that is oppositely charged to attract the particles.

An electrical liquid heating system and method of heating a liquid, according to the various embodiments of the invention disclosed herein, may have many beneficial applications. For example, it may be used to heat and/or treat the water of a hot tub or a swimming pool. In such an application, the breaking of at least some molecular bonds produces free oxygen that reduces microbes in the water. Also, by adding a salt to the water, the breaking of at least some molecular bonds produces chlorine that further reduces microbes in the water.

The various embodiments of the invention may be used to heat water in-line in a water supply system to a building. It may also be used to heat water used in a radiant heating system.

The various embodiments of the invention may be used to evaporate a liquid to a gas fluid. In such application, the liquid flow may include temporarily capturing the liquid to concentrate heat in the liquid to convert the liquid to gas as the fluid is released from captivity. Such system may be used, for example, as a steam source for humidification, for sterilization of instruments, to drive turbines, or the like. Because the electrical energy source heats the liquid and not the conductors, the embodiments disclosed herein may be used to process combustible liquids, such as hydrocarbons, without igniting the liquid. Thus, it may be used to heat fuel in an engine in order to convert the fuel to a gas to supply the fuel to the cylinders. Other embodiments will be apparent to the skilled practitioner.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. An electrical liquid heating system, comprising:

at least two spaced apart electrical conductors;

an electrical energy source applied to said conductors;

a liquid path defined between said conductors for bringing a liquid into contact with said conductors thereby delivering electrical energy to the liquid;

wherein electrical energy is delivered to the liquid at a power level that is sufficient to generate an electrical current to produce resistive heating of the liquid; and a regulator for regulating the delivery of electrical energy to the liquid, wherein said regulator at least partially disrupts the delivery of energy to a particular volume of the liquid, wherein said regulator creates non-conductive breaks in at least one of said conductors, wherein the liquid path provides for liquid flowing with respect to said conductors and wherein said non-conductive breaks are spaced along substantially the entire said at least one of said conductors in the direction of liquid flow, wherein electrical current is at least partially interrupted by the liquid flowing past said non-conductive breaks.

2. The system as claimed in claim 1 wherein electrical energy is delivered to the liquid at a power level that is sufficient to generate an electrical current to produce resistive heating of the liquid and to break at least some molecular bonds of molecules defining the liquid.

3. The system as claimed in claim 2 wherein said electrical energy source delivers energy at conventional house main power parameters.

4. The system as claimed in claim 1 wherein said non-conductive breaks comprise opening in said at least one of said conductors spaced along the direction of liquid flow.

5. The system as claimed in claim 1 wherein said non-conductive breaks comprise insulators spaced along said at least one of said conductors along the direction of liquid flow.

6. The system as claimed in claim 1 wherein said non-conductive breaks comprise dividing of said at least one of said conductors into a series of electrically interconnected conductor segments spaced apart in the direction of liquid flow.

7. The system as claimed in claim 6 wherein said regulator further includes at least one electrical switch, said switch selectively interconnecting particular conductor segments in order to control total conductive surface area.

8. The system as claimed in claim 7 wherein said electrical switch is in thermal contact with said at least one of said conductors to discharge heat to the liquid.

9. The system as claimed in claim 1 wherein said regulator further comprises a source of gas bubbles dispersed in the liquid, wherein an increase in gas bubbles reduces the amount of energy delivered to the liquid.

10. The system as claimed in claim 9 wherein said source of gas bubbles creates air bubbles.

11. The system as claimed in claim 10 wherein said source of gas bubbles comprises a venturi tube in the liquid flow path.

12. The system as claimed in claim 9 wherein said source of gas bubbles comprises another set of conductors connected with said energy source that separates gas from the liquid by breaking at least some molecular bonds of molecules defining the liquid.

13. The system as claimed in claim 1 including a monopolar magnet in said liquid stream in order to neutralize polarization of particles in the water created by said electrical energy source.

14. The system as claimed in claim 1 including a housing, said housing enclosing said conductors and liquid path.

15. The system as claimed in claim 14 wherein the liquid path provides for liquid flowing with respect to said conductors and wherein said housing defines a liquid inlet and a liquid outlet and including a ground plane positioned around at least one chosen from said liquid inlet and said liquid outlet.

16. The system as claimed in claim 14 wherein said housing is made substantially from an electrically insulating material.

17. The system as claimed in claim 16 wherein said housing is made at least in part from a polymeric material.

18. The system as claimed in claim 1 in combination with at least one chosen from a hot tub and a swimming pool.

19. The system as claimed in claim 1 wherein said electrical energy source produces alternating current at a high frequency.

20. The system as claimed in claim 19 wherein said electrical energy source produces alternating current at a frequency above one kilohertz.

21. The system as claimed in claim 1 including a liquid flow control to control the rate of liquid heating by controlling flow of the liquid.

22. A method of heating a liquid, comprising:

providing at least two spaced apart electrical conductors;

applying an electrical energy source to said conductors;

providing a liquid into contact with said conductors thereby delivering electrical energy to the liquid; and wherein said applying an electrical energy source comprises delivering electrical energy to the liquid at a power level that is sufficient to generate an electrical current to produce resistive heating of the liquid and including regulating delivery of electrical energy to the liquid, wherein said regulating includes disrupting the delivery of energy to a particular volume of the liquid, wherein said regulating includes creating non-conductive breaks in at least one of said conductors, wherein the liquid path provides for liquid flowing with respect to said conductors and wherein said non-conductive breaks are spaced along substantially the entire said at least one of said conductors in the direction of liquid flow, wherein electrical current is at least partially interrupted by the liquid flowing past said non-conductive breaks.

23. The method of heating a liquid as claimed in claim 22 wherein said applying an electrical energy source comprises delivering electrical energy to the liquid at a power level that is sufficient to generate an electrical current to produce resistive heating of the liquid and to break at least some molecular bonds of molecules defining the liquid.

24. The method of heating a liquid as claimed in claim 23 used to heat water in at least one chosen from a hot tub and a swimming pool.

25. The method of heating a liquid as claimed in claim 24 wherein said breaking at least some molecular bonds produces free oxygen that reduces microbes in the water.

26. The method of heating a liquid as claimed in claim 24 including adding a salt to the water and wherein said breaking at least some molecular bonds produces chlorine that reduces microbes in the water.

27. The method of heating a liquid as claimed in claim 23 used to heat water in-line in a water supply system to a building.

28. The method of heating a liquid as claimed in claim 23 used to heat fuel in an engine.

29. The method of heating a liquid as claimed in claim 23 used to heat water used in a radiant heating system.

30. The method as claimed in claim 22 including controlling the rate of liquid heating by controlling the liquid flow.

31. An electrical liquid heating system, comprising:

at least two spaced apart electrical conductors;

an electrical energy source applied to said conductors;

a liquid path defined between said conductors for bringing a liquid into contact with said conductors thereby delivering electrical energy to the liquid;

wherein electrical energy is delivered to the liquid at a power level that is sufficient to generate an electrical current to produce resistive heating of the liquid;

a regulator for regulating the delivery of electrical energy to the liquid, wherein said regulator at least partially disrupts the delivery of energy to a particular volume of the liquid, wherein said regulator creates non-conductive breaks in at least one of said conductors, wherein the liquid path provides for liquid flowing with respect to said conductors and wherein electrical current is at least partially interrupted by the liquid flowing past said non-conductive breaks; and a liquid flow control to control the rate of liquid heating by controlling flow of the liquid.

32. A method of heating a liquid, comprising:

providing at least two spaced apart electrical conductors;

applying an electrical energy source to said conductors;

providing a liquid into contact with said conductors thereby delivering electrical energy to the liquid;

wherein said applying an electrical energy source comprises delivering electrical energy to the liquid at a power level that is sufficient to generate an electrical current to produce resistive heating of the liquid and including regulating delivery of electrical energy to the liquid, wherein said regulating includes disrupting the delivery of energy to a particular volume of the liquid, wherein said regulating includes creating non-conductive breaks in at least one of said conductors, wherein the liquid path provides for liquid flowing with respect to said conductors and wherein electrical current is at least partially interrupted by the liquid flowing past said non-conductive breaks; and controlling the rate of liquid heating by controlling the liquid flow.

* * * * *